United States Patent [19]

Mills

[11] Patent Number: 4,502,608

[45] Date of Patent: Mar. 5, 1985

[54] DISPOSABLE LID FOR DRINKING CUPS

[76] Inventor: Kenneth Mills, 1521 Grand Blvd., Oakville, Ontario, Canada, L6H 3E4

[21] Appl. No.: 534,758

[22] Filed: Sep. 22, 1983

[30] Foreign Application Priority Data

May 16, 1983 [CA] Canada ..... 428249

[51] Int. Cl.[3] ..... B65D 41/48

[52] U.S. Cl. ..... 220/90.4; 215/254; 229/7 R

[58] Field of Search ..... 215/253, 254; 229/7 R, 229/43; 220/90.4, 90.2, 270, 271, 266; 206/604, 605

[56] References Cited

U.S. PATENT DOCUMENTS

| | | | |
|---|---|---|---|
| 2,689,664 | 9/1954 | Vingron | 215/253 |
| 3,042,286 | 7/1962 | Pottle | 206/830 X |
| 3,421,681 | 1/1969 | Frank | 220/90.4 X |
| 3,777,968 | 12/1973 | Law | 215/254 X |
| 3,800,999 | 4/1974 | Serritella | 229/7 R |
| 3,933,264 | 1/1976 | Rossi | 215/254 |
| 3,977,559 | 8/1976 | Lombardi | 220/90.4 |
| 3,994,411 | 11/1976 | Elfelt | 220/90.4 |
| 4,090,660 | 5/1978 | Schram et al. | 220/90.2 X |
| 4,202,459 | 5/1980 | Deparales | 220/90.4 |
| 4,210,272 | 7/1980 | Sequin | 229/7 R |
| 4,285,442 | 8/1981 | Wedzik | 220/270 |
| 4,322,015 | 3/1982 | Bailey | 220/90.2 |

*Primary Examiner*—Donald F. Norton
*Attorney, Agent, or Firm*—Donald E. Hewson

[57] ABSTRACT

A disposable lid for a drinking cup is provided, where the lid has a generally circular cavity formed around the periphery thereof to accommodate the lip of the circular mouth of a cup, and so as to fit snugly thereover. The central portion of the lid is generally planar, and there is a skirt portion which depends downwardly and outwardly from the cavity, and has a pair of cuts formed therein at the rim and through the thickness thereof, the cuts being spaced apart from each other a distance less than 25% of the circumference of the rim—generally they are spaced about 30 to 60 degrees apart. The rim cuts may be either notches or slits. A second cut is made in the central portion of the lid through the thickness thereof, in a place radially inwardly from the cavity but at a distance less than the radius of the lid, and has a length so as to extend at least between imaginary diameters that are drawn through the rim cuts.

11 Claims, 4 Drawing Figures

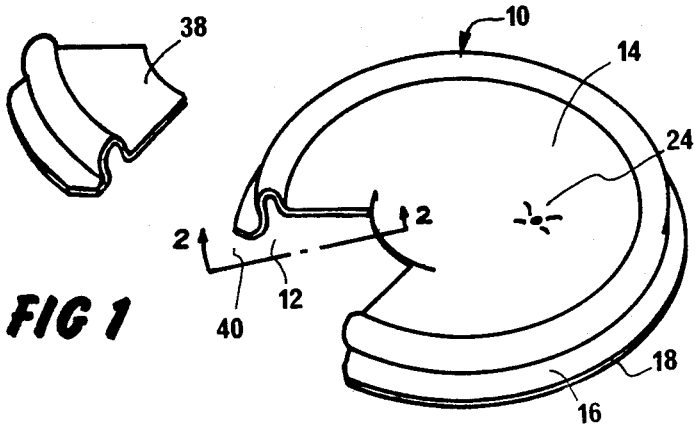
FIG 1
FIG 2
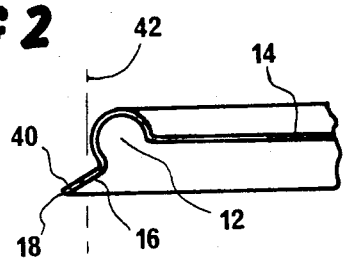
FIG 3
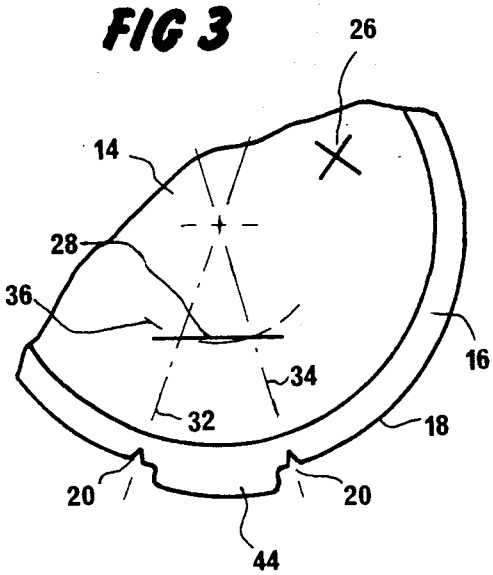
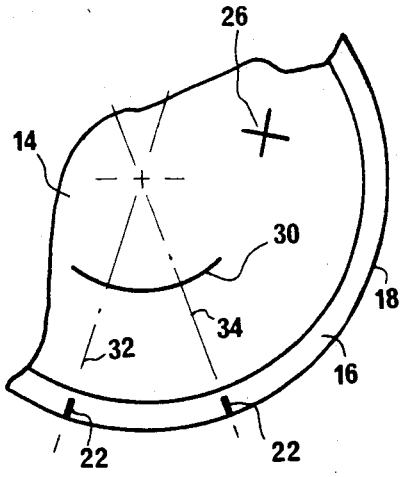
FIG 4

DISPOSABLE LID FOR DRINKING CUPS

FIELD OF THE INVENTION

This invention relates to disposable lids for drinking cups, and particularly to disposable lids for drinking cups where a portion of the lid may be removed without removing the entire lid from the cup so as to permit access by the user to the interior of the cup in order to sip or drink the contents therefrom.

BACKGROUND OF THE INVENTION

Disposable lids for drinking cups are well known, and are generally used in such circumstances were beverages are vended, dispensed or sold for consumption elsewhere. Such circumstances, of course, include the general sale of hot and cold beverages in coffee shops, cafeterias or offices, and in public places such as amusement parks or sports stadia, etc. One particular kind of sale that is specifically contemplated by the present invention, however, is the sale of hot and cold beverages—usually hot, such as coffee—from vending machines, road side restaurants and coffee shops, and the like, to persons such as truck drivers and salesmen who may wish to purchase their beverage and to drink it later while, perhaps, carefully driving their vehicle, or for persons purchasing or obtaining a cup of hot tea or coffee in such public modes of conveyance as airplanes or trains.

In any event, it is a principal purpose of the present invention to provide a disposable lid for a drinking cup, which lid is intended to substantially preclude spillage or splashing of beverage from the cup, after a small portion of the lid has been removed and disposed of so as to permit access to the beverage for purposes of consumption thereof. In these circumstances, it is contemplated that the user may remove a portion of the lid easily and without difficulty, and thereafter place the opening thus created to his mouth so as to drink the beverage.

It is accepted, however, by the present invention that once the opening has been created in the lid, it is the usual intention of the person having possession of the beverage in the cup to consume the beverage without necessarily wanting to re-seal the cup. In other words, it is accepted that there is neither any desire nor purpose to re-seal a cup if a portion of the lid has been removed; and that if the user has an intention to re-seal the cup after consuming only a portion of the contents, he would remove the lid from the cup rather than removing only a portion of the lid.

The present invention takes advantage of the fact that the material from which most disposable lids are made has a relatively thin cross-section, and is frangible or tearable. Most disposable lids are made from polystyrene or co-polymers having at least 70% to 90% by weight of styrene monomer component, or other suitable material; and in any event they are conveniently manufactured by extruding sheet material and vacuum forming the lids, after which they are cut and removed from the formed sheet for packaging. Because the material may be relatively easily torn, it is therefore not difficult to remove a portion of the lid away from the remainder of the lid, providing that the general size and shape of that portion is predetermined. This is particularly because of the toughness or resistance to tearing that the material of the lid may exhibit at the rim thereof—especially when the rim extends only a short distance from the wall of a cup onto whose mouth it is snugly received—and so as otherwise to preclude splashing or spilling the leverage.

However, the shape and size of a portion to be removed from the lid may be quite closely predetermined, by forming or making a pair of cuts in the rim, and by precluding the extent to which a tear will be made, in accordance with the present invention. At the same time, this invention recognizes and takes advantage of the fact that, when a tear is being made in a cup lid, it tends generally to extend inwardly at least from the inner side of the circumferentially extending cavity which receives and accommodates the mouth of the cup, in a generally radially directed fashion; that is, a tear which is made in a cup lid formed of relatively thin polystyrene or other suitable material will tend to be towards the center of the lid.

Several prior art patents are of interest, and they include the following:

Serritella, U.S. Pat. No. 3,800,999 issued Apr. 2, 1974, is particularly concerned with a lid having penetrable score lines that extend from the center of the lid at right angles to each other to the edge of the lid inside the rim of the cup, where they are joined by a straight fold score line, and an arcuate penetrable score line inside the rim of the cup. The score lines may extend across the edge of the lid to provide an option of breaking off the entire portion, but in any and all events the portion comprises two sides which extend to the center of the lid and which are at right angles to each other. The portion thus created is too large and promotes spillage because it is not manageable.

Lombardi, U.S. Pat. No. 3,977,559 issued Aug. 31, 1976, is particularly concerned with a re-sealable lid which has a flip-open section that extends from the peripheral edge of the lid along parallel or inwardly sloping sides to a pivot, whereby the flip-open section may be raised and lowered at will, about the pivot line. There is no substantial seal, however, because the beverage within the cup may pass through the slits that form the sides of the flip-open section, especially if the cup is jostled.

Elfelt et al., U.S. Pat. No. 3,994,411 issued Nov. 13, 1976 teaches a drink cup lid having two circumferentially spaced lines of performations formed in it, which extend equidistantly radially inwardly to spaced terminal points which eventually define a fold or pivot line. Means are provided for tucking a tab on the outer portion of the rim into a slot formed in the far central portion of the lid.

Schram et al., U.S. Pat. No. 4,090,660 issued May 23, 1978 teaches yet another disposable drinking cup lid, which again is particularly concerned with providing a pivot or fold area, and specifically is directed to precluding any tearing or breaking off the tab that is thus formed.

Deparales et al., U.S. Pat. No. 4,202,459 issued May 13, 1980, is also particulary concerned with a lid which has a segment that is reinforced so as to permit it to be bent numerous times without breaking.

Sequin, U.S. Pat. No. 4,210,272 issued July 1, 1980, also is concerned with the provision of a reclosable tear strip which has a hinge but which is particularly configured so as to preclude removal of the tear strip.

Wedzik, U.S. Pat. No. 4,285,442 issued Aug. 25, 1981, provides a pair of radially extending scored lines that converge towards each other and towards the center of the drinking cup lid, and the provision is made for segments that are adjacent to the center of the cup and cut completely through the material of the lid so that the user may remove a pie-shape piece of the lid by tearing it along the scored lines. In any event, the portion of the lid that is intended to be removed extends to the center of the lid.

Bailey, U.S. Pat. No. 4,322,015 issued Mar. 30, 1982 provides a lid which, once again, is particularly intended to have a reclosable strip that is terminated at its inner end by a fold line. The fold line, in this case, is defined by tear stop means which may be impressions or slits formed in the lid, localized thickenings or mechanical reinforcements, or otherwise; and in any event, as stated, the patent stresses a hinge or fold line rather than a removable portion.

In contradistinction to all of the above prior art, the present invention provides a lid for a drinking cup, where the lid is formed of frangible and tearable material of relatively thin cross-section compared to the diameter thereof, where a generally circular cavity is formed around the periphery of the lid and has a cross-sectional dimension so as to fit snugly over the lip of a cup when it is received in the cavity, and where there is a generally planar central portion inwardly of the cavity and a skirt portion depending downwardly and outwardly from the cavity, particularly having at least one pair of cuts formed in the rim of the lid at which the skirt portion terminates, and having a second cut made in the central portion of the lid through the thickness thereof in a place that is radially inwardly from the cavity at a distance less than the radius of the lid, where the second cut has a length so as to extend at least between imaginary diameters drawn through the rim cuts. The rim cuts are spaced apart from each other a distance less than 25% of the circumference of the rim, and generally about 30 to 60 degrees apart.

From the above, it is seen that the disposable lid accordingly to the present invention is such that a portion of the lid which does not extend inwardly to the center of the lid may be removed, without the necessity of or intention of hinging or folding that portion because, as stated, it is understood that once the opening has been made in the lid there is no effective way of resealing the lid. This practical consideration is, as noted, in contradistinction to most of the prior art, but practically recognized that it is usually the intention of the user to consume the beverage once a portion of the lid has been removed.

BRIEF DESCRIPTION OF THE DRAWINGS

The features and objects of the present invention will be described in greater detail hereafter, in association with the accompanying drawings. In which:

FIG. 1 is a general perspective view of a typical disposable lid according to the present invention, having a portion removed therefrom;

FIG. 2 is a cross-section through a typical lid in the direction of arrows 2—2 of FIG. 1;

FIG. 3 is a partial plan view of a lid having several features contemplated by the present invention; and FIG. 4 is a view similar to FIG. 3 showing alternative features according to the present invention.

DESCRIPTION OF THE PREFERRED EMBODIMENTS

The disposable lid 10 which is illustrated in FIG. 1 is one that is intended for a drinking cup, not shown. Such drinking cups may be formed of a plastics material or a coated paper—usually such cups have a rolled edge or rim—or it may be formed of expanded polystyrene beads. In any event, the drinking cups for which disposable lids according to the present invention are intended, have a generally circular mouth with a lip. A generally circular cavity 12 is formed around the periphery of the lid 10, and it has a cross-sectional dimension which is designed so as to fit snugly over the lip of a cup when the lip is received in the cavity 12. There are, of course, many configurations of cup lid that are intended for different kinds of cups, either hot drink or cold drink cups, of different sizes, and the specific configuration or details of the rim and cavity design are not considered herein.

The lid 10 is formed of a frangible and tearable material, for example polystyrene or a co-polymer having at least 70% to 90% by weight of styrene monomer; and generally, the disposable lid 110 is vacuum formed over a male mold or into a female mold, as may best be determined by the manufacturer and considering the specific type of cup to which the lid is to be fitted.

The lid 10, apart from the cavity 12, comprises a generally planar central portion 14 and a skirt portion 16. The skirt portion 16 depends downardly and outwardly from the cavity 12, and terminates at an outer rim 18.

It is a feature of the present invention that there is at least one pair of cuts—generally only one pair of cuts—formed in the skirt portion 16 at the rim 18; and it is also a feature of the present invention that the rim cuts are spaced apart from each other a distance less than 25% of the circumference of the rim. The rim cuts may take the form of notches 20, as shown in FIG. 3, or they may take the form of slits which tend radially inwardly in the skirt portion 16, as shown at 22 in FIG. 4. Generally, the rim cuts are spaced apart to an extent of 30 to 60 degrees.

Normally, there is formed in any disposable lid, a vent or straw hole, which may take the form of a hole 24 formed in a dimple as shown in FIG. 1, or a cross 26—which may form a straw hole—as shown in FIGS. 3 and 4.

In any event, there is also formed in the central portion 14 of the lid 10 a second cut 28 or 30 as shown in FIGS. 3 or 4, and the placement of that second cut 28 or 30 has a specific relationship to the notches 20 or slit 22.

In particular, the second cut 28 or 30 is made through the thickness of the planar central portion 14 at a place which is radially inwardly from the cavity 12 at a distance which is less than the radius of the lid 10, and in a place and having a length so as to extend at least between imaginary diameters 32 and 34 drawn through the rim cuts which comprise the notches 20 or slits 22. It is important to note that the imaginary diameters 32 and 34 are not, in fact, formed or placed on the lid, but are used herein for purposes of defining the cut 28 or 30. There are no score lines, perforations, or other mechanical working of the lid at the imaginary diameters 32 and 34.

More specifically, the second cut 28 is such that it is cross-wise of the lid in such a position that it substantially forms a chord of an imaginary circle (a portion of which is shown at 36 in FIG. 3) which is concentric with the rim 18 and which is drawn so as to pass through the intersections of the second cut 28 with the imaginary diameters 32 and 34. Also, as indicated in FIG. 3, the length of the cut 28 may be such as to extend past the imaginary diameters 32 and 34 at its ends.

In similar manner, the second cut 30 which may be made in a disposable lid as shown in FIG. 4, may take the form of a segment of an imaginary circle which is concentric with the rim 18, and also which is drawn so as to pass through the intersections of the second cut with the imaginary diameters 32 and 34. Moreover, in a manner similar to the second cut 28 of FIG. 3, the second cut 30 of FIG. 4 may be sufficiently long so as to extend beyond each of the imaginary diameters 32 and 34.

Of course, the exactness of the chord formed by the cut 28 or the segment of a circle formed by the cut 30, is a function of the manufacturing tolerance by which the lids 10 are formed, to the extent that the placement may be out of exact alignment as a chord or segment by several thousandths an inch. Such inexactness is, of course, not consequential, as the tearing action by which the segment 38 may be removed is not exactly radially inwardly directed. In any event, it is clear that the segment would be determined by the placement of the cut 28 or 30, so as to define the inward extent to which the generally radially inwardly directed tears may be made.

It will be seen that, if the portion of the rim 18 that lies between the notches 20 or the slits 22 is pried upwards, there will be a general tearing action of the material of the lid; and usually, that tearing action is generally radially inwardly directed. That is, by prying up on the portion of the rim 18 that lies between the notches 20 or slits 22, a generally radially inwardly directed tear may be induced, which tear will more or less follow the imaginary diameters 32 and 34 that are indicated in FIS. 3 and 4. That being the case, the tears that extend radially inwardly from the notches 20 or slits 22 will terminate at the cut 28 or 30. Thus, a generally truncated pie-shaped portion 38 may be removed, as shown in FIG. 1.

When the disposable lids of the present invention are formed, the vent hole 24 or straw slot 26—or other cutting that may be made in the lids—may be made by the placement of appropriate dies which move in an upward or downward direction perpendicular to the general plane of the planar central portion 14. Thus, the notches 20 or slits 22 may be formed by a cutting or punching die, and it is general therefore that the notches 20 or slits 22 extend radially inwardly in the skirt portion 16 to a radial distance which is less than the downward projection of the outermost radial extremity of the outer surface of the lid at the cavity 12. This is indicated particularly in FIG. 2, where a portion 40 which may be the edge of a notch 20 extends radially inwardly to an extent less than line 42 which defines the outermost radial extremity of the outer surface of the lid 10 at cavity 12. The line 42, in other words, defines the innermost extent to which a cutting die may extend when it is forming the notches 20 or slits 22.

There is also shown, in FIG. 3, an outwardly extending tab portion 44, which may be formed in the rim of the lid 10, extending outwardly beyond the general circumference of the lid as defined by the rim 18, and in a position between the notches 20. Likewise, of course, a tab 44 may be formed in the lid indicated in FIG. 4 between the slits 22.

There has been described a disposable lid for a drinking cup, having several alternative embodiments, whereby notches or slits may be formed in the rim from which radially inwardly directed tears may be made. The inward extent of the radially inwardly directed tears is determined by the presence of a second cut formed through the thickness of the lid at a position that is at a a distance less than the radius of the lid. The second cut which is thus formed may have several different forms, so long as it extends generally between imaginary diameters that are drawn through the rim cuts. A tab portion may be formed in the outer rim of the lid between the rim cuts, to make the inwardly directed tearing action somewhat easier.

Other alternative arrangements may be made, and specific features of the disposable lid according to the present invention incorporated, without departing from the spirit and scope of the appended claims.

What is claimed is:

1. A disposable lid for a drinking cup having a generally circular mouth with a lip, said lid being formed of frangible and tearable material of relatively thin cross-section compared to the diameter of said lid and adapted to fit over said lip, and comprising:

a generally circular cavity formed around the periphery of said lid and of a cross-sectional dimension so as to fit snugly over said lip when said lip is received in said cavity;

a generally planar central portion inwardly of said cavity; and a skirt portion depending downwardly and outwardly from said cavity and terminating at an outer rim where at least one pair of cuts is made in said skirt portion at said rim through the thickness thereof, said rim cuts being spaced apart from each other a distance less than 25 percent of the circumference of said rim;

and where a second cut is made in said central portion through the thickness thereof in a place radially inwardly from said cavity at a distance less than the radius of said lid, said second cut having a length so as to extend at least between imaginary diameters drawn through said rim cuts.

2. The disposable lid of claim 1, where said rim cuts are notches which extend inwardly in said rim.

3. The disposable lid of claim 2, where said notches extend inwardly to a radial distance less than the downward projection of the outermost radial extremity of the outer surface of said lid at said cavity.

4. The disposable lid of claim 2 or 3, where said second cut is crosswise of said lid and substantially forms a chord of an imaginary circle concentric with said rim and drawn so as to pass through the intersections of said second cut with said imaginary diameters.

5. The disposable lid of claim 2 or 3, where said second cut is crosswise of said lid and substantially forms a chord of an imaginary circle concentric with said rim and drawn so as to pass through the intersections of said second cut with said imaginary diameters, and said second cut extends past said imaginary diameters.

6. The disposable lid of claim 2 or 3, where said second cut is crosswise of said lid and substantially forms a segment of an imaginary circle concentric with said rim and drawn so as to pass through the intersections of said second cut with said imaginary diameters.

7. The disposable lid of claim 2 or 3, where said second cut is crosswise of said lid and substantially forms a segment of an imaginary circle concentric with said rim and drawn so as to pass through the intersections of said second cut with said imaginary diameters, and said second cut extends past said imaginary diameters.

8. The disposable lid of claim 1, where said rim cuts are slits which extend radially inwardly in said rim.

9. The disposable lid of claim 8, where said slits extend inwardly to a radial distance less than the downward projection of the outermost radial extremity of the outer surface of said lid at said cavity.

10. The disposable lid of claim 2 or 3, where an outwardly extending tab is formed in the rim of said lid and extends outwardly beyond the general circumference of said lid in a position between said notches.

11. The disposable lid of claim 8 or 9, where an outwardly extending tab is formed in the rim of said lid and extends outwardly beyond the general circumference of said lid in a position between said slits.

* * * * *